US010461467B2

(12) United States Patent
Eppley et al.

(10) Patent No.: US 10,461,467 B2
(45) Date of Patent: Oct. 29, 2019

(54) COMPACT CARD EDGE CONNECTOR

(71) Applicant: FCI USA LLC, Etters, PA (US)

(72) Inventors: Nazareth Eppley, Camp Hill, PA (US); Charles Copper, Hummelstown, PA (US); Paul Rubens, Allen, TX (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/875,927

(22) Filed: Jan. 19, 2018

(65) Prior Publication Data

US 2018/0212361 A1 Jul. 26, 2018

Related U.S. Application Data

(60) Provisional application No. 62/448,942, filed on Jan. 20, 2017.

(51) Int. Cl.
*H01R 13/62* (2006.01)
*H01R 13/627* (2006.01)
*H01R 12/72* (2011.01)

(52) U.S. Cl.
CPC ..... *H01R 13/6275* (2013.01); *H01R 12/721* (2013.01)

(58) Field of Classification Search
CPC ..... H01R 12/721; H01R 12/7005; H01R 12/7029; H01R 12/737
USPC ..... 439/160, 327, 328
See application file for complete search history.

(56) References Cited

U.S. PATENT DOCUMENTS 4,521,065 A * 6/1985 Nestor ..... H01R 12/721 439/328
4,931,021 A * 6/1990 Mohan ..... G02B 6/3833 439/284
5,035,641 A * 7/1991 Van-Santbrink ..... H01R 12/7023 439/329
5,110,298 A * 5/1992 Dorinski ..... H01L 24/10 439/55
5,411,402 A * 5/1995 Bethurum ..... G06K 19/07743 29/857
5,581,877 A * 12/1996 Woychik ..... H01L 25/50 228/180.21
5,629,839 A * 5/1997 Woychik ..... H05K 3/366 361/784

(Continued)

FOREIGN PATENT DOCUMENTS

EP 1207587 A2 5/2002
JP 2009-129682 A 6/2009

OTHER PUBLICATIONS

International Search Report and Written Opinion for International Application No. PCT/US2018/014421 dated May 4, 2018.

*Primary Examiner* — Ross N Gushi

(74) *Attorney, Agent, or Firm* — Wolf, Greenfield & Sacks, P.C.

(57) ABSTRACT

A card edge connector with latching that enables a compact connector. The connector includes a latch, centrally located along the connector. The latch may be aligned with an alignment rib of the connector housing, reducing the space required for the latch. In some embodiments, portions of the latch may be bifurcated so that the latch may straddle the rib. In this way, space for a latch in a circuit assembly using the connector may be less than in conventional connector with latches on each end.

11 Claims, 6 Drawing Sheets

(56) References Cited

U.S. PATENT DOCUMENTS 5,754,411 A * 5/1998 Woychik ..... H05K 3/366 361/784
5,777,855 A * 7/1998 Yokajty ..... H01R 12/62 361/749
5,954,536 A * 9/1999 Fuerst ..... H01R 12/79 439/493
6,062,911 A * 5/2000 Davis ..... H01R 13/2492 439/630
6,102,734 A * 8/2000 Kuo ..... H01R 13/73 439/545
6,135,781 A * 10/2000 Pope ..... H01R 12/716 439/59
6,139,357 A * 10/2000 Shih ..... H01R 12/62 439/493
6,246,016 B1 * 6/2001 Roessler ..... H01L 23/49805 174/261
6,496,384 B1 * 12/2002 Morales ..... H05K 3/366 29/830
6,599,142 B2 * 7/2003 Bu ..... H01R 12/721 439/157
6,623,292 B1 9/2003 Holler et al.
6,629,855 B1 * 10/2003 North ..... H05K 7/1405 439/325
6,672,888 B1 * 1/2004 Ku ..... H01R 12/7005 439/153
6,695,630 B1 * 2/2004 Ku ..... H05K 7/1431 439/152
6,709,283 B2 * 3/2004 Lai ..... H01R 13/639 439/153
6,746,257 B2 * 6/2004 Billman ..... H01R 12/721 439/160
6,796,831 B1 * 9/2004 Yasufuku ..... H05K 7/1431 439/160
6,802,732 B1 * 10/2004 Bu ..... H01R 12/7005 439/157
6,824,407 B1 * 11/2004 Zhao ..... H01R 12/721 439/157
6,848,927 B2 * 2/2005 Shirai ..... H01R 12/721 439/326
6,884,100 B1 * 4/2005 Hsiao ..... G06F 1/184 439/327
7,029,307 B1 * 4/2006 Ling ..... H01R 43/26 439/327
7,121,862 B2 * 10/2006 Tang ..... H01R 12/716 439/327
7,182,610 B2 * 2/2007 Lin ..... H01R 12/707 439/567
7,244,134 B2 * 7/2007 Ju ..... H01R 12/7005 439/327
7,371,103 B2 * 5/2008 McGrath ..... H01R 12/7005 439/327
7,374,441 B2 * 5/2008 Rubenstein ..... H01R 12/7023 439/153
7,379,021 B2 * 5/2008 Lee ..... H01Q 1/243 343/700 MS
7,462,049 B2 * 12/2008 Chen ..... H01R 12/7005 439/160
7,484,978 B1 * 2/2009 Gao ..... H01R 13/627 439/157
7,500,863 B2 * 3/2009 Ringler ..... H01R 13/6275 439/159
7,578,689 B2 * 8/2009 Guan ..... H01R 13/6273 439/327
7,618,270 B2 * 11/2009 Scherer ..... H01R 12/7005 439/152
7,658,628 B2 * 2/2010 Guan ..... H01R 13/6273 439/157
7,661,974 B1 * 2/2010 Sun ..... H05K 7/1431 439/327
7,677,907 B2 * 3/2010 Guan ..... H01R 12/7029 439/157
7,710,740 B2 * 5/2010 Liu ..... H05K 1/147 361/748
7,716,821 B2 * 5/2010 Yan ..... H05K 3/366 228/180.22
7,864,544 B2 * 1/2011 Smith ..... H05K 3/366 361/770
7,866,995 B1 * 1/2011 Kudo ..... H01R 12/721 439/157
7,876,576 B2 * 1/2011 Mills ..... H01R 12/7011 361/747
7,892,006 B2 * 2/2011 Guan ..... H01R 12/7029 439/328
7,922,506 B1 * 4/2011 Harlan ..... H01R 12/7005 439/160
7,938,658 B1 * 5/2011 Zeng ..... H01R 12/7029 439/160
7,985,086 B1 * 7/2011 Sun ..... H01R 13/62988 439/157
8,075,330 B1 * 12/2011 Deng ..... H01R 12/7005 439/328
8,087,950 B1 * 1/2012 Deng ..... H01R 13/6275 439/328
8,113,863 B2 * 2/2012 Vrenna ..... H01R 12/721 439/327
8,157,576 B2 * 4/2012 Fu ..... H01R 12/721 439/153
8,169,378 B2 * 5/2012 Barson ..... H01Q 1/005 343/770
8,254,123 B2 * 8/2012 Sun ..... H05K 7/20727 361/695
8,272,897 B1 * 9/2012 Lin ..... H01R 13/6594 439/607.4
8,277,235 B2 * 10/2012 Lu ..... H01R 12/737 439/157
8,328,567 B1 12/2012 Yang
8,403,689 B2 * 3/2013 Li ..... H01R 12/721 439/160
8,422,242 B2 * 4/2013 Lin ..... H05K 7/142 361/748
8,482,932 B2 * 7/2013 Tian ..... G06F 1/185 361/784
8,517,746 B2 * 8/2013 Manickam ..... H01R 13/633 439/160
8,550,836 B2 * 10/2013 Ma ..... G06F 1/185 439/328
8,559,187 B2 * 10/2013 Peng ..... H05K 7/1431 361/798
8,585,417 B2 * 11/2013 Chien ..... H01R 12/7005 361/801
8,654,031 B2 * 2/2014 Livingston ..... H01Q 1/088 343/700 MS
8,665,587 B2 * 3/2014 Peng ..... G06F 1/185 361/679.31
8,771,001 B2 * 7/2014 Li ..... H01R 13/639 439/160
8,926,348 B2 * 1/2015 Ma ..... H01R 12/72 439/160
8,951,068 B2 * 2/2015 Tai ..... H01R 12/52 439/620.18
8,979,561 B2 * 3/2015 Kerrigan ..... H01R 12/716 439/157
9,095,069 B2 * 7/2015 Stefanoff ..... H05K 1/142
9,370,101 B2 * 6/2016 Ishihara ..... H05K 3/0032
9,426,889 B2 * 8/2016 Liu ..... H05K 1/147
9,780,471 B2 * 10/2017 Van Rijswijk ..... H05K 1/141
2002/0071259 A1 * 6/2002 Roos ..... H05K 3/366 361/784
2003/0236006 A1 * 12/2003 Yamashita ..... H01R 43/0256 439/65
2004/0214466 A1 * 10/2004 Lin ..... H05K 1/142 439/325
2004/0248444 A1 12/2004 Zhao et al.
2006/0128174 A1 * 6/2006 Jang ..... H05K 3/366 439/65
2007/0010121 A1 * 1/2007 Haneishi ..... H01R 12/721 439/327

(56) References Cited

U.S. PATENT DOCUMENTS

2007/0032117 A1* 2/2007 Huang ..... H01R 12/721 439/327
2007/0096995 A1* 5/2007 Lee ..... H01Q 1/243 343/702
2007/0275587 A1* 11/2007 Chang ..... H01R 12/7029 439/327
2008/0090440 A1* 4/2008 Beaman ..... H01R 13/533 439/327
2009/0017666 A1* 1/2009 Lim ..... H05K 7/1405 439/328
2009/0023332 A1* 1/2009 Ringler ..... H01R 12/585 439/513
2009/0035978 A1* 2/2009 Calhoun ..... H01R 27/00 439/327
2009/0077293 A1* 3/2009 Kerrigan ..... H05K 7/1409 710/301
2010/0022114 A1* 1/2010 Chiu ..... H01R 13/62988 439/328
2010/0167570 A1* 7/2010 Yang ..... H01R 12/7023 439/325
2010/0202119 A1* 8/2010 Nagami ..... H05K 1/0281 361/749
2011/0045681 A1* 2/2011 Tsai ..... H01R 12/7029 439/328
2011/0076868 A1* 3/2011 Yao ..... H01R 12/7005 439/153
2011/0081797 A1* 4/2011 Chang ..... H01R 12/7005 439/327
2011/0149543 A1* 6/2011 Kamoi ..... H05K 1/141 361/803
2011/0237101 A1 9/2011 Yang
2011/0305852 A1* 12/2011 Sugaya ..... H05K 3/0044 428/33
2012/0149223 A1* 6/2012 Feldman ..... H01R 13/62933 439/157
2012/0156912 A1* 6/2012 Shen ..... H01R 12/737 439/327
2012/0178276 A1* 7/2012 Lee ..... H01R 12/7005 439/327
2012/0322287 A1* 12/2012 Lu ..... H01R 12/7011 439/328
2013/0078825 A1* 3/2013 Wain ..... H05K 3/366 439/64
2013/0288504 A1* 10/2013 Sass ..... H01R 12/7029 439/328
2014/0099815 A1* 4/2014 Foster, Sr. ..... H01R 12/7029 439/327
2014/0179167 A1* 6/2014 Long ..... H01R 12/7088 439/630
2014/0301052 A1* 10/2014 Chen ..... H05K 3/32 361/760
2014/0363994 A1* 12/2014 Li ..... G06F 1/18 439/160
2014/0364000 A1* 12/2014 Tang ..... H01R 12/7005 439/345
2015/0144383 A1* 5/2015 Goodwin ..... H05K 1/0284 174/255
2015/0163944 A1* 6/2015 Goodwin ..... H05K 7/1053 361/679.33
2015/0236437 A1* 8/2015 Briant ..... H01R 12/737 439/636
2015/0318627 A1* 11/2015 Berry, Jr. ..... H01R 12/7076 714/6.32
2015/0319861 A1* 11/2015 Bandhu ..... H05K 1/0228 174/261
2016/0013588 A1* 1/2016 Yang ..... H05K 7/1409 439/157
2016/0013589 A1* 1/2016 Fu ..... H01R 12/7005 439/157
2016/0020539 A1* 1/2016 Li ..... H01R 12/707 439/155
2016/0043487 A1* 2/2016 Li ..... H01R 12/7029 439/155
2016/0365653 A1* 12/2016 Takai ..... G02B 6/4284
2017/0194731 A1* 7/2017 Van Rijswijk ..... H05K 1/141
2017/0352991 A1* 12/2017 Lin ..... H01R 12/7005
2017/0367206 A1* 12/2017 Yang ..... H01R 12/721
2018/0076560 A1* 3/2018 Tang ..... H01R 12/714
2018/0090864 A1* 3/2018 Niu ..... H01R 12/721
2018/0138612 A1* 5/2018 Lin ..... G06F 1/185
2018/0212361 A1* 7/2018 Eppley ..... H01R 13/6275
2018/0212362 A1* 7/2018 Wang ..... H01R 12/7029

* cited by examiner

COMPACT CARD EDGE CONNECTOR

RELATED APPLICATIONS

This application claims priority to and the benefit of U.S. Provisional Patent Application No. 62/448,942, entitled "COMBINED LATCHING AND GUIDANCE MECHANISM FOR CARD EDGE CONNECTOR" filed Jan. 20, 2017. The entire contents of the foregoing are hereby incorporated herein by reference.

BACKGROUND

Many electronic systems include connectors to enable subassemblies to be manufactured separately and later assembled into a functioning system. Connectors also enable subassemblies to be added, removed or replaced after the system has been initially manufactured. Connectors may be attached to cables for connecting separate devices into a system. In other configurations, connectors may enable subassemblies within one device to interoperate.

An example of a connector that might be used within an electronic device is called a card edge connector. A card edge connector may be attached to a printed circuit board in an electronic device. That printed circuit board may be called a "motherboard." The card edge connector may include a slot into which the forward edge of a card is inserted. The card may be a smaller printed circuit board with components, such as memory components, attached to the printed circuit board.

The card has contact pads on a surface near the forward edge. Contact elements within the slot press against these contact pads, forming electrical connections between the card and the connector. Those contact elements pass through the connector and extend from a mounting face of the connector where they are attached to the printed circuit board. Inserting the card into the connector forms conducting paths through the connector between the card and the motherboard. As the components on the card are connected through the printed circuit board to the contact pads, inserting the card into the connector enables electronic components on the card to work as part of a system with the components attached to the motherboard.

Some card edge connectors may include one or more alignment ribs that span the slot. The alignment ribs have defined relationships relative to the contact elements in the slot. Openings in the card, which are sized to receive the alignment ribs, have that same defined relationship to the contact pads on the cards. When the card is inserted into the slot, the alignment ribs enter the openings in the card, aligning the openings to the alignment ribs and, as a consequence, aligning the contact pads to the contact elements.

Locking a card in a connector ensures proper functioning of the electronic system by retaining the card in a position in which the contact pads are engaged with the contact elements. To ensure proper retention of the card in the connector slot, a card edge connector may include latches at the edge of the slot. These latches can be pushed toward the sides of the card, inserting projections into cutouts in the side of the card.

FIG. 1 illustrates an edge connector 1 with latches according to a conventional design. The connector 1 includes a molded insulative housing 10 which has a first end 12 and a second end 14 which are connected by a slot 15 in topside 16. This housing also includes a bottom side 18 and a first lateral side 20 and a second lateral side 22.

A card which may be inserted into connector 1 is shown in phantom lines generally at numeral 23. The card 23 has a front edge 24 which engages the slot 15 in the housing 10 and an opposed top edge 25 and a first side edge 26 and a second side edge 27. The card 23 has conductive pads (not shown) disposed along each side of edge 24.

Rows of contacts (not visible in FIG. 1) are positioned on opposite sides of the slot 15. Each contact forms an electrical connection with a corresponding one of the conductive pads.

Extending from the bottom side 18 of the housing are leads as at 32 and 34 and non-conductive locating pins as at 36 and 38, both of which engage a mother board (not shown). The housing also includes a first upstanding member 40 which has a slot 41 aligned with and substantially the same width as slot 15 and a second upstanding member 42 which also has a slot 43 aligned with and substantially the same width as slot 15.

The housing also includes stand-offs as at 48 and 50 which bear against the mother board when the housing is engaged with the mother board.

The edge connector 1 includes a first latching member shown generally at numeral 52 and a second latching member shown generally at 54. Each of these latching mechanisms includes an upper shank 56 and a lower ejectment or ejector hook 58. On the upper shank 56 there are lateral pivot projections on both sides of the latching members 52 and 54 by means of which the latching mechanism is fixed to apertures 62 in the insulative housing 10.

Each of the latching members 52 and 54 pivots on the projections in apertures 62 from a position in which it is engaged with card 23 as shown in solid lines in FIG. 1 to a rearward angular position in which it is disengaged from the card 23 as shown in phantom. With the latches in their rearward disengaged position, the card 23 may be inserted in the housing 10 so that its front edge 24 engages slot 15 and its side edges 26 and 27 respectively engage slots 41 and 43 in the upstanding members 40, 42.

As the card 23 is pushed into slot 15, the edge 24 of the board engages the ejector hook 58 of each latch member 52 and 54 causing the latch members to pivot on the projections in aperture 62. The latching mechanism also includes a head section shown generally at numeral 78. In the locked position, the front nose of the head section engages a recess in the card so that the board is properly located and secured in position. The latching mechanism is ordinarily manipulated by means of the finger tab 82, to rotate the latch and eject the board from the connector.

SUMMARY

In accordance with some embodiments, an improved latching arrangement is provided in a card edge connector.

In one aspect, a card with a plurality of contact pads on a surface of the card is adjacent a forward edge, the card comprising an elongated first opening through the surface, the elongated opening extending perpendicularly to the forward edge, the elongated opening having a first width and extending from the forward edge to a second opening through the surface, the second opening having a second width, greater than the first width.

In another aspect, a card edge connector comprises a housing comprising a slot shaped to receive an edge of a card, an array of contacts disposed along walls of the slot, and a locking system. The locking system comprises a latch member pivotally mounted to the housing between a first portion of the array of contacts and a second portion of the array of contacts. The latch member pivots between an unlocked position and a locked position. The latch member comprises a central portion having a first end and a second end, wherein the central portion is pivotally mounted to the housing between the first end and the second end. The latch member further comprises a first protrusion at the first end that extends into the slot when the latch member is in the locked position, the first protrusion extending from the central portion in a first direction when the latch member is in the locked position, and the latch member further comprises a second protrusion at the second end, the second protrusion extending from the central portion in the first direction when the latch member is in the locked position.

In yet another aspect, a method of operating a card edge connector configured to receive a card comprises positioning a card so that a first opening on a forward edge of the card aligns with a rib in a slot of the connector, inserting the card into the slot, such that the forward edge of the card contacts a latch member adjacent the rib, and further inserting the card into the slot to pivot a first end of the latching member away from the slot and a second end of the latch member toward the slot. The second end of the latch member may comprise a protrusion. Inserting the card into the slot pivots the protrusion through a second opening through a surface of the card.

The foregoing is a non-limiting summary of the invention, which is defined by the appended claims.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. Various embodiments of the invention will now be described, by way of example, with reference to the accompanying drawings, in which.

DETAILED DESCRIPTION

The inventors have recognized and appreciated that conventional latches for card edge connectors occupy space on a motherboard to which the connector is attached. The inventors have further recognized and appreciated improved latch designs that can reduce the need for using space on the motherboard, beyond what is used for other purposes, to accommodate latching components. Such connector designs may provide electronic systems that are more desirable to users and more cost effective to manufacture. Users frequently prefer smaller electronic devices. Moreover, the cost of manufacturing an electronic system may increase with increased size of the motherboard. Latching systems as described herein nonetheless ensure proper retention of the card, preventing system failures.

Figure 1:
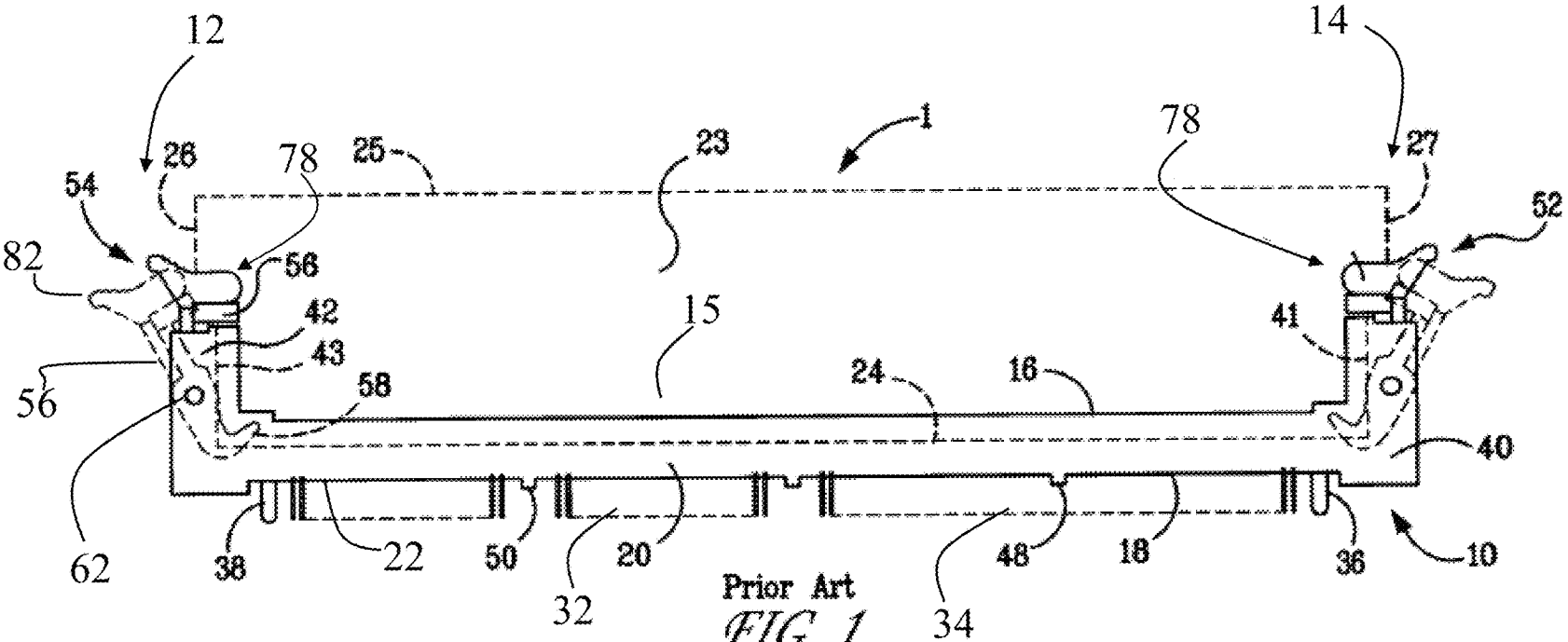
Prior Art FIG. 1
FIG. 1 is a front view of a card edge connector with a conventional latching structure.

In accordance with some embodiments, latching may be achieved by a projection/protrusion of a latching member entering an opening through a surface of the card on which the contact pads are disposed. The latching member may be mounted in a central portion of the connector, at least partially disposed within the slot, rather than being mounted at the end of the slot and expanding the length of the connector beyond the slot, as is shown, for example, in FIG. 1. The opening that receives the latching member may be located at a corresponding position in a central portion of the card.

In accordance with some embodiments, the opening in the card may be positioned above an opening in the card designed to receive an alignment rib, further reducing separate space required for the latching member. With such a configuration, the latching member of the connector may occupy, at least in part, space that would not otherwise be occupied by components providing electrical functionality. The latching member in accordance with some embodiments may be aligned with an alignment rib of the housing, which is in a space not conventionally occupied by components providing electrical functionality.

The opening in the circuit card may similarly be positioned in an area that would not conventionally be occupied by components providing electrical functionality. The area of the card adjacent the forward edge is conventionally used for contact pads and connections to those contact pads. In the vicinity of an opening to engage an alignment rib there are no contact pads and therefore no connections to pads either, such that an opening through the surface of the card to receive a projection of a latching member can be positioned, in whole or in part, in an area of the card that might otherwise have been unused.

In some embodiments, a latching member may be mounted on one side of the slot in the connector, aligned with an alignment rib. The latching member may be mounted to a housing of the connector by two pivot bearings in a central portion of the latching member. The latching member may have a first end that projects into the slot when the latch is in an unlocked position. A card inserted into the slot may push on the first projecting end such that the latching member pivots when a card is inserted.

A second end of the latching member may have a protrusion designed to fit into an opening of a card. As the card insertion causes the latch to rotate into the latched position, the protrusion on the second end may pivot into an opening on the card, precluding the card from being drawn out of the slot unless a counter force is placed on the latch protrusion or other portion of the latching member near the second end. Such a counter force may cause the latching member to pivot into the unlatched position, removing the projection from the opening in the card and, in some embodiments, causing the first end of the latching member to exert an upward force on the card, unseating it from the slot.

In some embodiments, the latching member may be precluded from pivoting, absent a sufficient force on the second end of the latching member, by one or more features on the latching member that may engage with corresponding features on the connector housing. For example, side protrusions on sides of the latching member may inhibit pivoting of the latching member out of the latched position. The side protrusions may be retained, for example, by notches on the connector until disengaged by a user.

Figure 2:
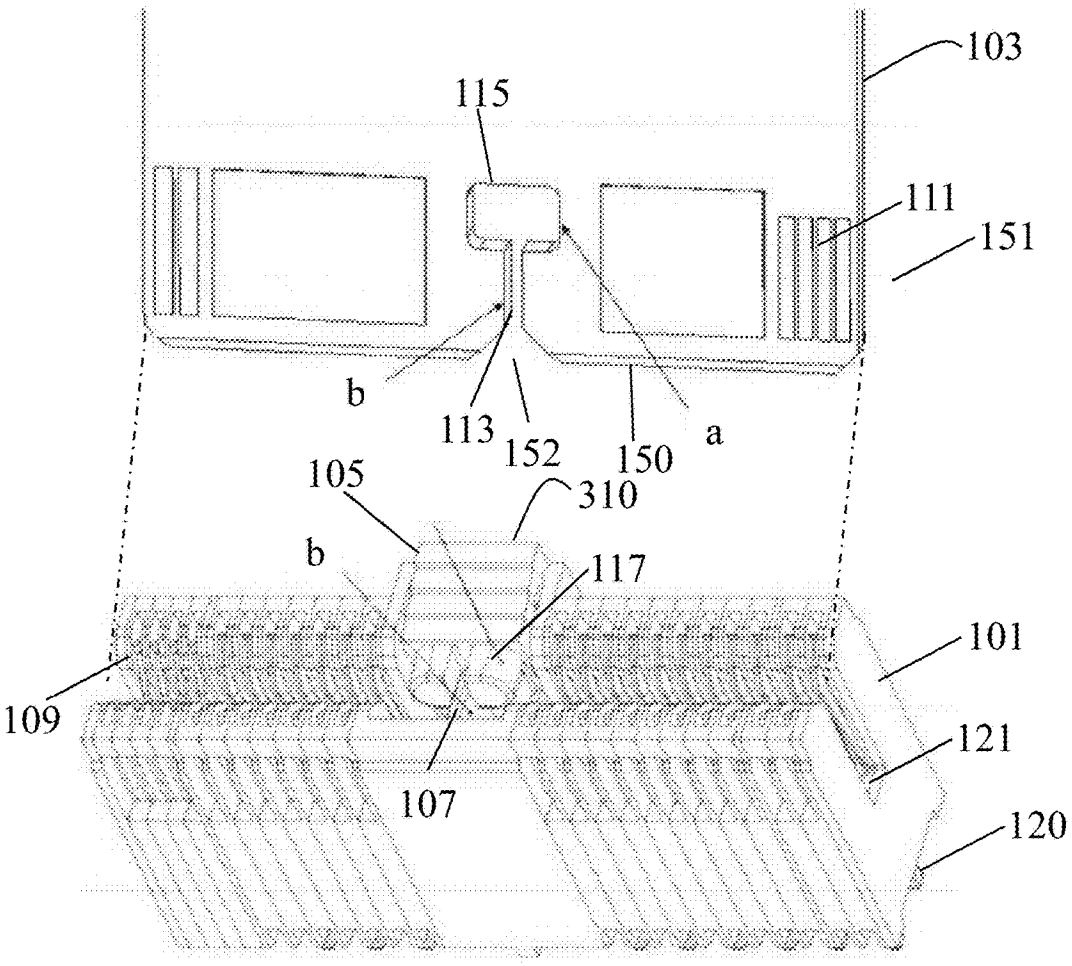
FIG. 2 is a left, front perspective view of a card aligned with a connector with a latching mechanism according to some exemplary embodiments.

FIG. 2 shows a card edge connector 101 in accordance with some embodiments. In the embodiment illustrated, connector 101 is configured to receive a card 103, shown aligned with but not inserted in slot 121 of connector 101.

In the illustrated embodiment, connector 101 comprises a housing 120 with slot 121 with an array of contacts 109 along walls of the slot. The connector housing 120 may be made of insulative materials and the contacts may be made of compliant conductive material, as is conventional in an electrical connector. Slot 121, and therefore the arrays of contacts 109, may be bisected by an alignment rib 107. The alignment rib 107 extends at least partially across the housing slot 121 in a first direction. In some embodiments, the alignment rib may fully extend across the housing slot 121.

Figure 4:
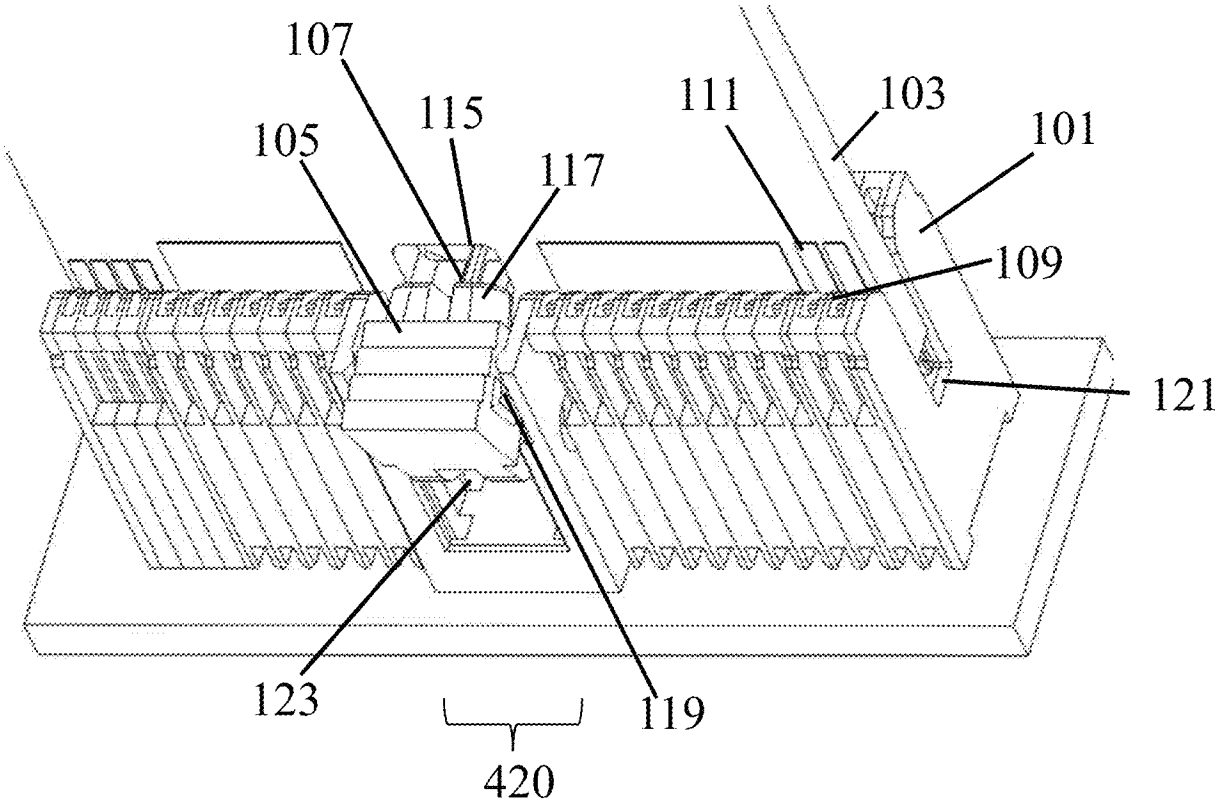
FIG. 4 is a right, rear side perspective view of a card edge connector as shown in FIG. 2 with the card partially inserted into the connector.

Alignment rib 107 may be positioned in a portion 420 (FIG. 4) of connector 101 that is free of contacts 109. Such a portion, in addition to aiding in guiding a card 103 into slot 121 may provide mechanical support to the connector. In some embodiments, portion 420 may include a latching member as described below, enabling integration of a latching member in an area of an electronic assembly that might otherwise be unoccupied by electronic components.

Slot 121 is shaped to receive an edge of a card 103, such that contact pads 111 on card 103 mate with the contacts 109 when the card 103 is inserted in slot 121. Card 103 may be a printed circuit board with any one or more electronic components. In some embodiments those components may comprise computer memory chips. In some embodiments, the "card" may itself be a memory module, such as a DDR4 memory with one or more semiconductor chips attached to or embedded in a substrate according to known manufacturing techniques.

The card 103 may have contact pads 111 on a surface making electrical connections to the electronic components of the card. The contact pads 111 may be positioned in a pattern with a pitch, which may match the pattern and pitch of contacts within connector 101. In the embodiment illustrated, contact pads 111 extend from the front edge 150 of the card 103. All of the contact pads 111 may have the same shape and size. However, one or more contact pads may have different shapes and sizes. In some embodiments, the contact pads 111 have a rectangular shape and are arranged parallel to one another, although other configurations are possible. In the embodiment illustrated, some of the contact pads 111 have a width that is narrow relative to the length of the contact pads 111 while others have a relatively wider width. The wider pads, for example, may carry power while the narrower pads may be designed to carry signals.

The plurality of contact pads 111 is bisected into a first group and a second group of contact pads by a first opening 113. In some embodiments, the first opening 113 may comprise an elongated first opening on a surface of the card 103 adjacent a forward edge 150. From the forward edge, the elongated first opening 113 may extend through the card in a direction perpendicular to the surface and extend perpendicularly to the forward edge 150. The elongated opening may have a first width and extend from the forward edge 150 to a second opening 115, which may also extend through the card 103 in a direction perpendicular to the surface. The second opening 115 may have a second width greater than the first width. In accordance with some embodiments, the first width may be between 0.5 mm and 1.5 mm, and the second width may be between 3 mm and 10 mm.

The first opening 113 may aid in positioning card 103 within slot 121 of connector 101. In some embodiments, the first opening 113 may be shaped and positioned to align with an alignment rib 107 of the connector 101. In the embodiment of FIG. 2, the alignment rib 107 extends across slot 121 of connector 101. As illustrated by the example embodiment of FIG. 2, the first opening 113 may be located in a central region 152 of a forward portion 151 of the card 103 and may extend at least 4 mm from the forward edge 150. The mouth of the first opening 113 may be tapered, facilitating alignment of the first opening 113 with the alignment rib 107 upon insertion of the card 103 into the slot 121.

In accordance with some embodiments, the contacts 109 within the connector 101 may be spaced in a predetermined pattern relative to the alignment rib 107. Contact pads 111, configured for mating with the contacts 109 of the connector 101, may have this same predetermined pattern relative to the first opening 113. This pattern may be set by a standard, for example a DDR4 standard, or in any other suitable way. The contacts 109 may be aligned parallel to one another and are shaped and sized to mate with the contact pads 111. In some embodiments, the first opening 113 may bisect the contact pads 111 into a first group and a second group of contact pads.

Card 103 also has a second opening 115. The elongated first opening 113 may have a first width and extend from the forward edge 150 to second opening 115 through the surface. The second opening 115 may have a second width greater than the first width.

In accordance with some embodiments, the second opening 115 may be rectangular. Such an opening may have two sets of parallel sides, intersecting at corners. The corners may be rounded or shaped other than at a 90 degree angle, and the opening may nonetheless be regarded as rectangular. In some embodiments, the two sets of parallel sides may be substantially of equal length, and the second opening may be square. In other embodiments, the second opening 115 may be trapezoidal with the edge closest the forward edge 150 being shorter than an edge of the opening further from the forward edge. However, the second opening 115 may be of any suitable shape that facilitates receipt of a latch protrusion. For example, the second opening 115 may be triangular or round.

Second opening 115 may be shaped and positioned to facilitate latching card 103 in connector 101. In the embodiment illustrated, connector 101 includes a latching member 105. Latching member 105 may be pivotally mounted within the housing 120 of connector 101 adjacent slot 121. In some embodiments, the latching member 105 may be pivotally mounted to the housing 120 between a first portion of the array of contacts 109 and a second portion of the array of contacts 129 such that the latching member 105 pivots between an unlocked and a locked position, where the first portion and the second portion of the array of contacts correspond to the first and second group of contact pads of the card 103. Latching member 105 may have a first end that extends into slot 121 when latching member 105 is in an unlocked position. A second end of latching member 105 may have one or more protrusions 117 shaped to fit within second opening 115. When card 103 is inserted into slot 121, the forward edge of card 103 may press against the first end of latching member 105, causing it to pivot. That pivoting motion may cause a corresponding pivoting motion of the second end toward card 103 in slot 121. Inserting card 103 sufficiently into slot 121 may pivot the protrusions 117 into or, in some cases through, second opening 115, locking card 103 in the slot 121 until latching member 105 is moved into an unlocked position.

FIG. 2 shows latching member 105 in the locked position, such that the first end and second end are the same distance from the slot 121. To insert a card into slot 121, a user may press on finger portion 310 of latching member 105, causing it to rotate into an unlocked position. In the unlocked position, protrusions 117 are pivoted to be offset from slot 121, creating free passage of card 103 into slot 121.

Figure 3:
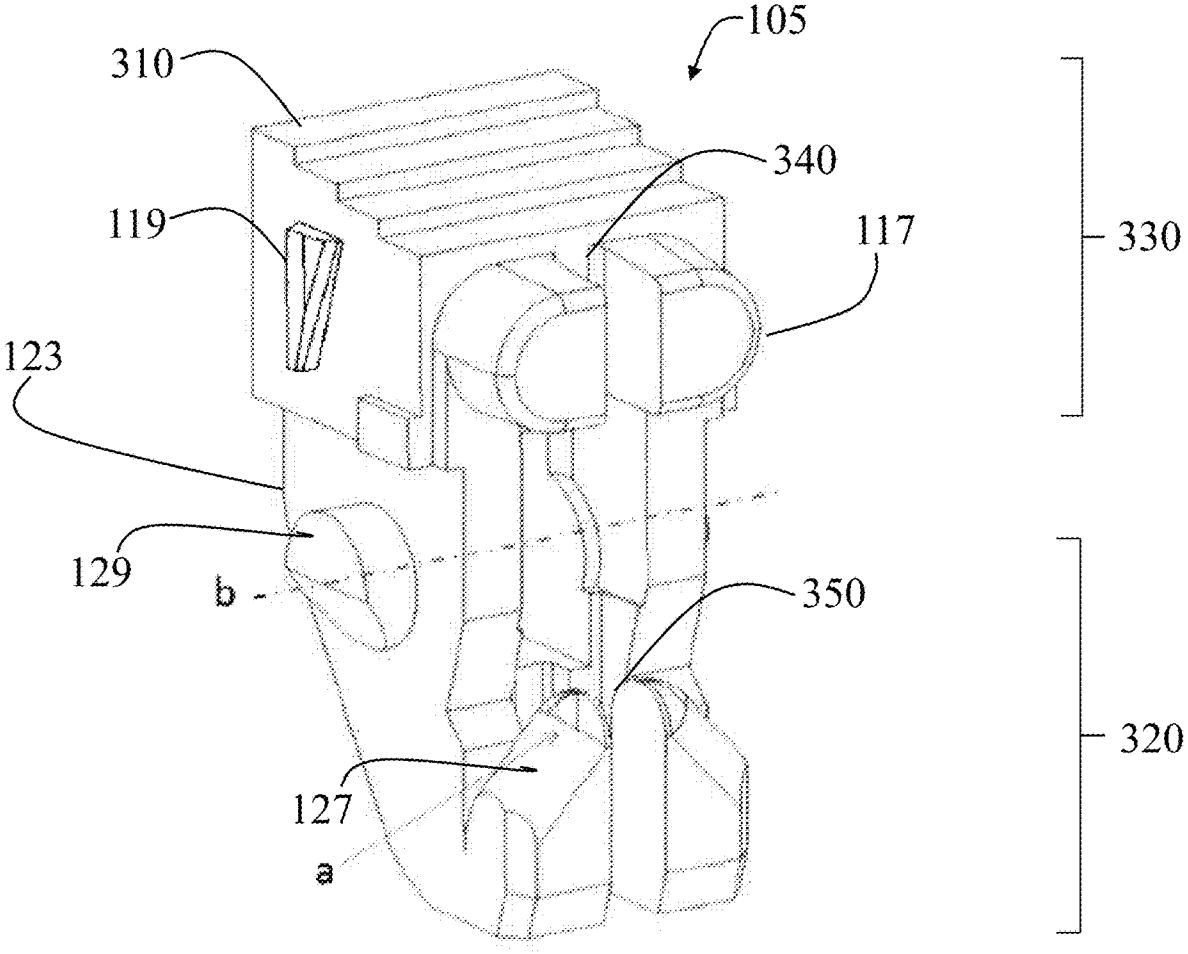
FIG. 3 is a perspective view of a latching member according to some exemplary embodiments.

FIG. 3 shows additional detail of latching member 105. The latching member 105 comprises a central portion 123 having a first end 320 and a second end 330. The second end 330 may have a protrusion 117 that extends in a first direction. Protrusion 117 may have a rectangular shape that conforms to the second opening 115 of the card 103. With the latching member 105 and card 103 in the locked configuration, the protrusion 117 may be retained within the opening 115 or intersect the card 103. In some embodiments, the protrusion 117 may comprise two sub-parts with a gap 340 separating them. The gap 340 may provide space for an alignment rib 107 to be inserted in when the latching member 105 is in the locked position.

The first end 320 may have a protrusion 127 that extends in the first direction. In some embodiments, the protrusion 127 may comprise two sub-parts with a gap 350 separating them. The gap 350 may be in-line with the gap 340 that separates the sub-parts of protrusion 117, allowing the full length of the alignment rib 107 to be inserted within the first end 320 and second end 330 when the latching member 105 is in the locked position.

The central portion 123 is pivotally mounted to the connector housing between the first end 320 and the second end 330. Such a pivotal mounting may enable latching member 105 to pivot between a locked and unlocked position. To facilitate such a pivotal mounting, the central portion 123 may have pivot arms 129.

Pivot arms 129 extend from a surface of latching member 105 between the first end 320 and the second end 330. In the embodiment illustrated, latching member 105 is symmetric about an axis extending vertically in FIG. 3. Accordingly, though a single pivot arm 129 is visible in FIG. 3, one of skill in the art will appreciate that a second pivot arm 129 may be present, enabling pivoting around an axis labeled 'b" in FIG. 3. When latching member 105 is assembled into connector 101, pivot arms 129 may extend into openings in the housing, serving as bearings for the pivot arms 129.

With the latching member 105 in the locked position, protrusion 117 and protrusion 127 may extend in the first direction for the same distance. In the unlocked position, the first end 320 and protrusion 127 may extend further into the slot 121. The protrusion 127 may have features that cause the first end 320 to pivot away from the slot 121 in response to a downward force. Pivoting the first end 320 away from the slot 121 may cause the second end 330 to pivot into the slot 121.

Central portion 123 may further comprise side protrusions 119 on the same surface as pivot arms 129 such that the side protrusions are orthogonal to a surface of the connector adjacent to the contacts 109. The side protrusions 119 may be positioned such that they abut notches 125 (FIG. 6) on the corresponding housing wall. In other embodiments, the side protrusions 119 may comprise indentations that are orthogonal to a surface of the connector adjacent to the contacts 109, whereby the notches 125 may be retained in the indentations. In the unlocked position shown in FIG. 4, the card 103 is partially inserted into the housing slot 121 of the connector 101 and the latching member 105 is pivoted into an unlocked position. With the card 103 positioned in slot 121, the alignment rib 107 enters a corresponding first opening 113 on the forward edge 150 of the card 103, which aligns the position of the card 103 and contact pads 111 with respect to the connector 101 and the contacts 109.

Inserting the card 103 further into the housing slot 121 causes the card 103 to contact the first end 320 (FIG. 3) that extends from the central portion 123 of the latching member 105. In some embodiments, the first end 320/protrusion 127 may have one side with a surface that is slanted away from the latching member 105 in a first direction, and another side with a second surface that is slanted away from the latching member 105 in a second direction, such that a downward force of the card 103 on the surfaces causes first end 320 to move away from the slot 121 and the latching member 105 to pivot about pivot arms 129. During pivoting, the first end 320 of latching member 105 moves away from the slot 121 and the second end 330 of the latching member 105 moves toward the slot 121. Protrusion 117 at the second end of latching member 105 may be pivoted through second opening 115 through a surface of the card 103 when the card 103 is fully inserted into the housing slot 121. In some embodiments, inserting the card 103 into the slot 121 to pivot the first end 320 of the latching member 105 may include engaging a tapered mouth of the first opening 113 with tapered surfaces of the latching member 105 associated with the first end 320/protrusion 127.

With the latching member 105 in the locked position, a first protrusion 127 at the first end 320 may be pushed out of the portions of slot 121 that receive the card and a second protrusion 117 may extend from the central portion 123 in the first direction through a second opening 115 through a surface of the card 103. Protrusion 117 may also extend from the second end 330 in the first direction. During pivoting of latching member 105, side protrusions 119 on either side of the latching member 105 contact notches 125 on the connector housing. Insertion of card 103 into the connector 101 forces the latching member 105 to pivot against the force of the side protrusions 119 engaging with the notches 125. Fully pivoting causes the side protrusions 119 to move over the notches 125. In the locked position, the side protrusions 119 abut the notches 125 and resist the pivoting of the second end 330 of the latching member 105 out of the disengagement of the card 103 and out through the second opening 115.

Figure 5:
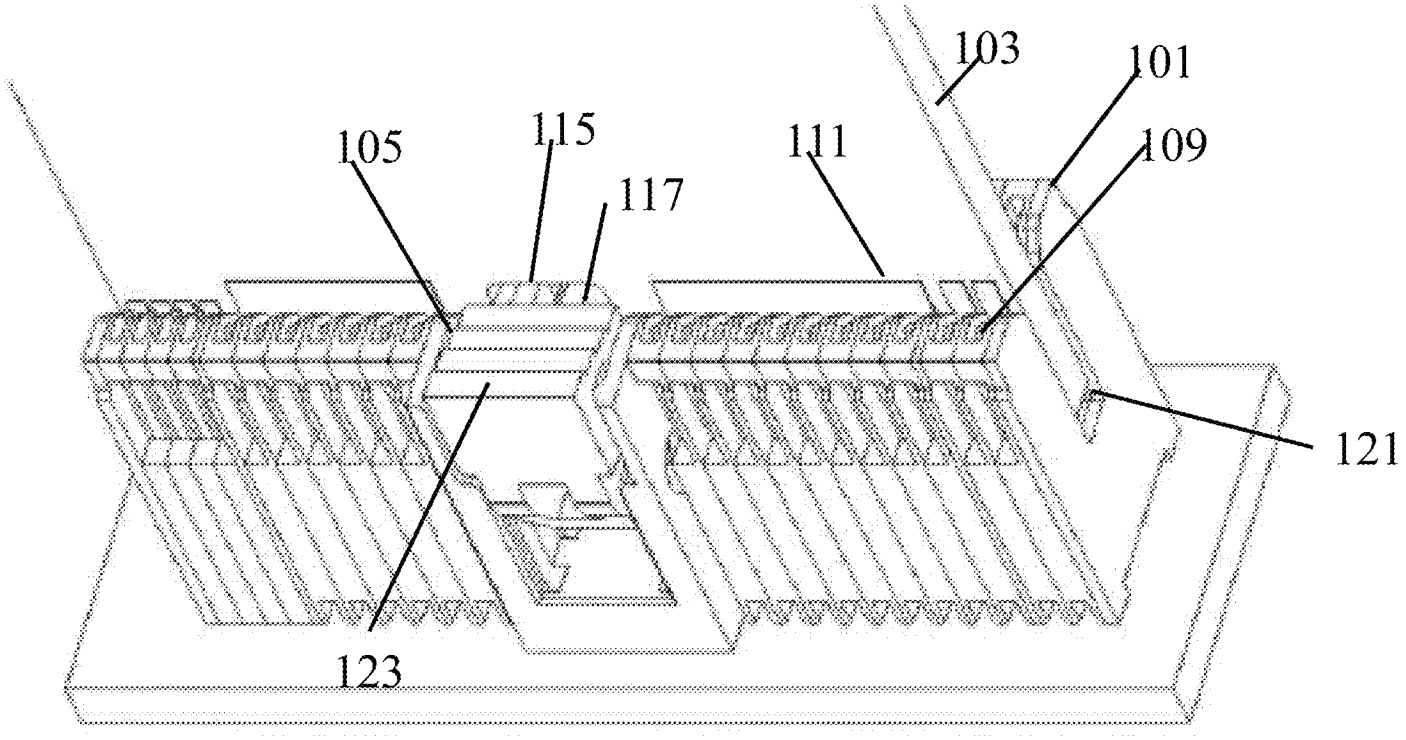
FIG. 5 is a right, rear side perspective view of embodiment card edge connector as shown in FIG. 2 in the latched configuration.

FIG. 5 shows latching member 105 in the locked position. In this position, the contact pads 111 may be mated to the contacts 109 on the card 103, and the card 103 may be fully inserted into the housing 103. The card 103 may be fixed in place by the latching system. The protrusion 117 of the latching member 105 is inserted through the second opening 115 on a surface of the card 103. The protrusion 117 secures the card 103 from being inadvertently pulled from the slot 101.

Latching member 105 may be secured by the side protrusions 119 (FIG. 3), which are retained by the notches 125 (FIG. 6) on either side of the connector housing 120. The raised notches 125 block the side protrusions 119 from moving over the notches 125 without an applied force, preventing accidental removal of the card 103. The alignment rib 107 may resist lateral motion, as the alignment rib 107 may fit in a gap in protrusion 117 and the second end 330.

To remove the card 103 from the slot 121, a force must be placed on a finger portion 310, or another portion of the latching member 105 on the second end, such that the protrusion 117 is pushed out of the second opening 115. Such a force may move the side protrusions 119 over the notches 125, causing the second end 330 of the latching member 105 to pivot away from the slot 121 and the first end 320 of the latching member to pivot toward the slot. The pivoting would result in the protrusion 117 being removed from the second opening 115 in the card 103. This configuration unlocks the card 103 from its position. Although the alignment rib 107 still fills the first opening 113, the card 103 may be removed from the housing slot 121. In some embodiments, pivoting to the unlocked position may cause the first end 320 of the latching member 105 to exert an upward force on the card 103, unseating it from the slot 121.

Figure 6:
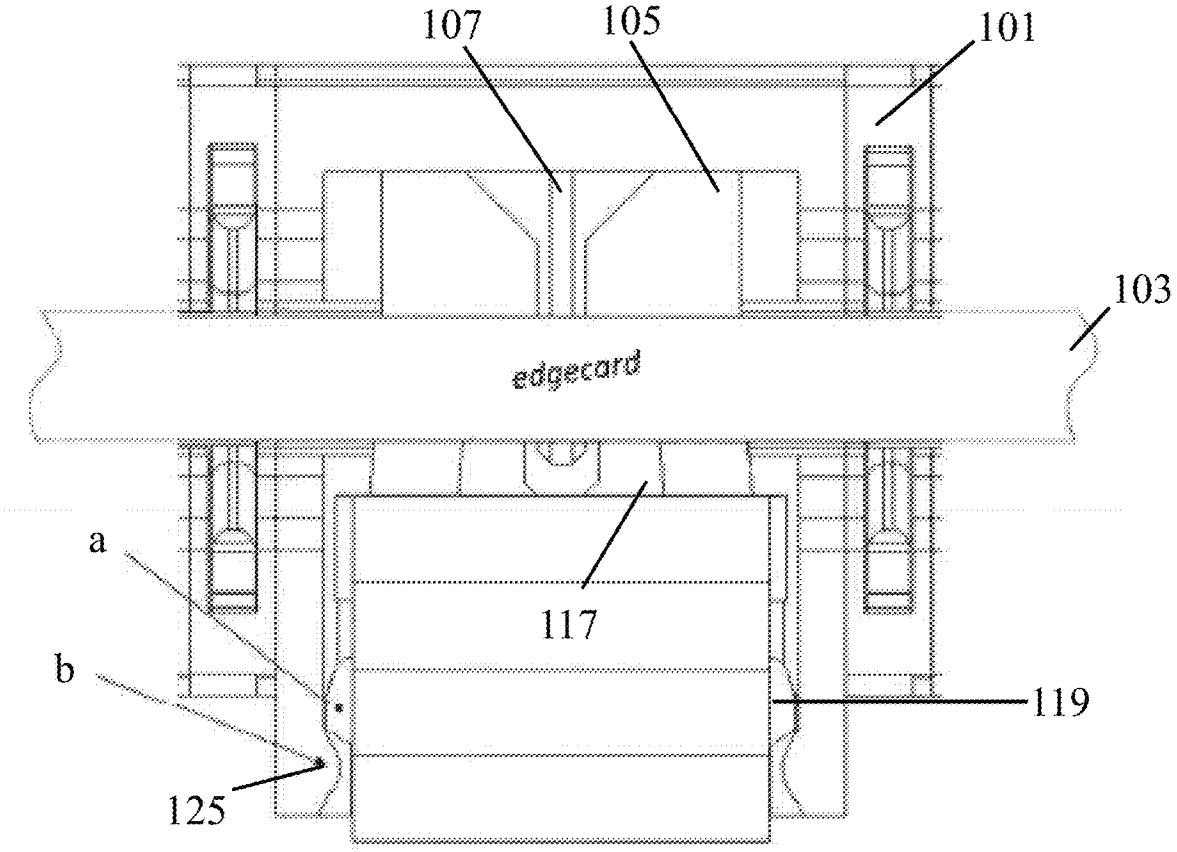
FIG. 6 is a top plan view of the embodiment of FIG. 2 with the latching mechanism in the latched configuration.

FIG. 6 shows a top plan view of the latching system in the locked position of FIG. 5. The alignment rib 107 spans the slot 121, and the protrusion 117 intersects the card 103, although in some embodiments, the protrusion 117 does not intersect the card 103. The latching member 105 has a cut-out such that the latching member 105 straddles the alignment rib 107. On the sides, notches 125 extend from either end and retain side protrusions 119, which are prevented from moving away from the slot 121. A force must be applied to the central portion 123 to allow the side protrusions 119 to overcome the notches 125. Other embodiments of retaining side protrusions 119 are possible, such as using recesses into which side protrusions 119 drop.

It should be understood that aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

As an example of a variation, it is described above that an alignment rib 107 extends fully across a slot 121 in the connector 101, from one wall to the opposing wall. It should be appreciated that any feature extending into the slot 121 may act as the alignment rib. That feature may extend from either wall or from the floor of the slot 121.

As an example of another variation, while a unitary latching member 105 is pictured, the latching member 105 may be constructed from any desired number of components held together in any suitable way. As a specific example, the unitary latching member 105 is shown with two portions, separated by an opening designed to align with the alignment rib 107. In some embodiments, the two portions may be separately manufactured and then attached to each other.

As an example of another variation, while a housing slot 121 with arrays of contacts 109 on both walls is shown, a housing slot 121 may be provided without contacts 109 covering both walls. For example, only one wall may have contacts 109, or half of each wall may have contacts 109.

What is claimed is:

1. A card edge connector, comprising:

a housing comprising a slot shaped to receive an edge of a card;

an array of contacts disposed along walls of the slot, and a latching member pivotally mounted to the housing between a first portion of the array of contacts and a second portion of the array of contacts such that the latching member pivots between an unlocked position and a locked position, wherein the latching member comprising a central portion having a first end and a second end;

the central portion is pivotally mounted to the housing between the first end and the second end;

the latching member comprises a first protrusion at the first end that extends into the slot when the latching member is in the locked position, the first protrusion extending from the central portion in a first direction when the latching member is in the locked position; and the latching member further comprises a second protrusion at the second end, the second protrusion extending from the central portion in the first direction when the latching member is in the locked position.

2. The connector of claim 1, wherein:

the housing further comprises an alignment rib spanning the slot; and the central portion and the first protrusion of the latching member comprise at least a first side and a second side, separated by a gap; and the alignment rib fits within the gap when the latching member is in the locked position.

3. The connector of claim 2, wherein:

the housing further comprises a first side on the first portion of the array of contacts and a second side on the second portion of the array of contacts;

a notch on the first side extends in a first direction; and a notch on the second side extends in a second direction.

4. The connector of claim 3, wherein:

the central portion further comprises a first side that opposes the first side of the housing;

the central portion further comprises a second side that opposes the second side of the housing;

a protrusion on the first side extends in a first direction; and a protrusion on the second side extends in a second direction.

5. The connector of claim 4, wherein:

the second protrusion comprises a first surface; and the second protrusion is slanted away from the latching member.

6. A method of operating a card edge connector configured to receive a card, the method comprising:

positioning a card so that a first opening on a forward edge of the card aligns with a rib in a slot of the connector;

inserting the card into the slot, such that the forward edge of the card contacts a first end of a latching member adjacent the rib; and further inserting the card into the slot to pivot the first end of the latching member away from the slot and a second end of the latching member toward the slot, such that a protrusion at the second end of the latching member pivots through a second opening through a surface of the card.

7. The method of claim 6, wherein:

pivoting the protrusion through the second opening locks the card in the connector.

8. The method of claim 6, wherein:

the latching member comprises a first portion and a second portion with a third opening therebetween; and pivoting the latching member comprises pivoting the latching member with the rib in the third opening of the latching member.

9. The method of claim 6, wherein:

the surface of the card comprises a plurality of contact pads thereon; and inserting the card into the slot comprises engaging the contact pads with contacts of the connector within the slot.

10. The method of claim 6, wherein the first opening has a tapered mouth and the first end of the latching member comprises tapered surfaces; and inserting the card into the slot to pivot the first end of the latching member comprises engaging the tapered mouth of the first opening with the tapered surfaces of the latching member.

11. The method of claim 6, wherein:

the protrusion at the second end of the latching member is a first protrusion;

the latching member has a second protrusion, extending from the latching member in a direction orthogonal to the first protrusion; and the method further comprises engaging the second protrusion of the latching member with a feature on the connector so as to hold the latching member in a locked configuration.

* * * * *